US009431766B1

(12) United States Patent
Belisle

(10) Patent No.: US 9,431,766 B1
(45) Date of Patent: Aug. 30, 2016

(54) KEYED POWER CONNECTOR

(71) Applicant: Hamilton Sundstrand Corporation, Charlotte, NC (US)

(72) Inventor: Francis C. Belisle, Roscoe, IL (US)

(73) Assignee: HAMILTON SUNSTRAND CORPORATION, Charlotte, NC (US)

( * ) Notice: Subject to any disclaimer, the term of this patent is extended or adjusted under 35 U.S.C. 154(b) by 0 days.

(21) Appl. No.: 14/688,329

(22) Filed: Apr. 16, 2015

(51) Int. Cl.
*H01R 13/64* (2006.01)
*H01R 13/645* (2006.01)

(52) U.S. Cl.
CPC ..... *H01R 13/6456* (2013.01)

(58) Field of Classification Search
CPC ..... H01R 13/6456
USPC ..... 439/680
See application file for complete search history.

(56) References Cited

U.S. PATENT DOCUMENTS 7,326,090 B2 * 2/2008 Cayzac ..... H01R 13/6453 439/378

* cited by examiner

*Primary Examiner* — Javaid Nasri

(57) ABSTRACT

A keyed power connection system is disclosed. The keyed power connection system may have connectors and terminal studs. Each connector may have a captive fastener and may have a connector keying portion comprising a keyed aperture forming an opening in and defined by a connector body of the connector and having a keyed connector diameter. The connector may receive and be selectably connected to a terminal stud having a keyed stud diameter. The keyed stud diameter and the keyed connector diameter may correspond to ameliorate the risk of connecting a connector to a mismatched terminal stud. The captive fastener may engage the terminal stud to retain the connector in position relative to the terminal stud.

13 Claims, 3 Drawing Sheets

KEYED POWER CONNECTOR

FIELD

The present disclosure relates generally to electrical connectors, and more specifically to keyed electrical connectors.

BACKGROUND

Installation of electrical power feeders using standard lugs and terminal studs exposes systems to risk of damage due to misconnection of lugs to studs. Various efforts to address this challenge include labels, which tend to fall off, color-coding, which fades and/or discolors over time, and varying thread sizes of studs, which increases the number and variety of tools and hardware used in assembly and maintenance.

SUMMARY

The forgoing features and elements may be combined in various combinations without exclusivity, unless expressly indicated herein otherwise. These features and elements as well as the operation of the disclosed embodiments will become more apparent in light of the following description and accompanying drawings.

A keyed power connection system is disclosed. The keyed power system may have a connector. The connector may include a connector fastening portion having a captive fastener, a connector electrical conduction portion including a connector body configured to retain the connector fastening portion in movable communication with the connector, and a connector keying portion having a keyed aperture forming an opening in and defined by the connector body and including a keyed connector diameter.

A keyed power connection system may have a terminal stud. The terminal stud may include a terminal stud keying portion having a post including a cylindrical boss configured to support a terminal stud fastening portion, a keyed stud diameter including a diameter of the post, and a terminal stud electrical conduction portion having a terminal stud conductive surface disposed annularly about the post. The terminal stud fastening portion may include a fastener receiving threaded bore having a cylindrical channel defined by the post and extending axially into the post.

BRIEF DESCRIPTION OF THE DRAWINGS

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein refers to the accompanying drawings, which show exemplary embodiments by way of illustration. While these exemplary embodiments are described in sufficient detail to enable those skilled in the art to practice embodiments of the disclosure, it should be understood that other embodiments may be realized and that logical changes and adaptations in design and construction may be made in accordance with this invention and the teachings herein. Thus, the detailed description herein is presented for purposes of illustration only and not limitation. The scope of the disclosure is defined by the appended claims. For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected or the like may include permanent, removable, temporary, partial, full and/or any other possible attachment option. Additionally, any reference to without contact (or similar phrases) may also include reduced contact or minimal contact.

Furthermore, any reference to singular includes plural embodiments, and any reference to more than one component or step may include a singular embodiment or step. Surface shading lines may be used throughout the figures to denote different parts but not necessarily to denote the same or different materials.

Power distribution systems, such as on vehicles (e.g., aircraft), often involve large gauge electrical power feeders. Such large gauge feeders are often connected via lugs attached to terminal studs, and due to their large gauge are often not connected via multi-conductor connectors.

However, such connections may potentially be misconnected. For instance, there may be multiple of such connections in relative proximity. For instance, a power feeder and a power return, or multiple phase power feeders, and/or the like may be located in close proximity. During maintenance operations, multiple such connections may be disconnected and reconnected. Thus, it is possible that lugs may be attached to the incorrect terminal studs. Various strategies to address this challenge are presented herein. For instance, a connector may be sized to only receive studs of corresponding size and may be associated with a captive fastener. Thus, various different connectors may be differently sized to prevent misconnection. Moreover, because the fastener is captive, the fastener is less subject to being lost. Furthermore, because the connector itself provides the keying rather than, for instance, the fastener, a single tool of a single size may be used to tighten/loosen connectors of a variety of different sizes, because differently sized connectors may have similarly sized fasteners.

Figure 1:
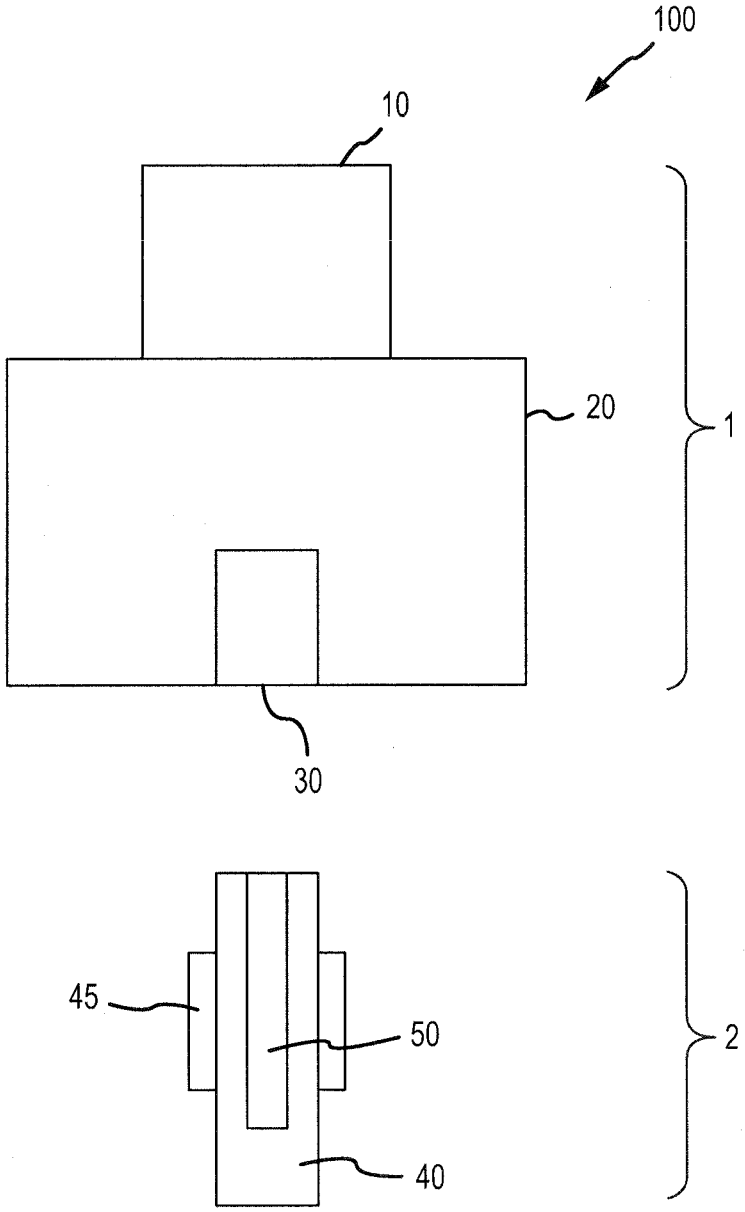
FIG. 1 illustrates a block diagram of a keyed power connection system, according to various embodiments.

With reference now to FIG. 1, a keyed power connection system 100 may comprise a connector 1 and a terminal stud 2. The keyed power connection system 100 may enable the connection and disconnection of electrical power conducted between the connector 1 and the terminal stud 2 and may further prevent misconnection of connector(s) 1 to incorrect terminal stud(s) 2.

The connector 1 may comprise a connector fastening portion 10, a connector electrical conduction portion 20, and a connector keying portion 30. Similarly, the terminal stud 2 may comprise a terminal stud keying portion 40, a terminal stud electrical conduction portion 45, and a terminal stud fastening portion 50.

The connector fastening portion 10 and the terminal stud fastening portion 50 may selectably interconnect and disconnect to hold the connector electrical conduction portion 20 in selectable physical contact with the terminal stud electrical conduction portion 45. In this manner, electrical power may be conducted between the connector 1 and the terminal stud 2. Moreover, the connector keying portion 30 and the terminal stud keying portion 40 may interact to permit the interconnection of the connector 1 to a corresponding terminal stud 2 while preventing the interconnector of the connector 1 to an incorrect terminal stud 2.

Figure 2:
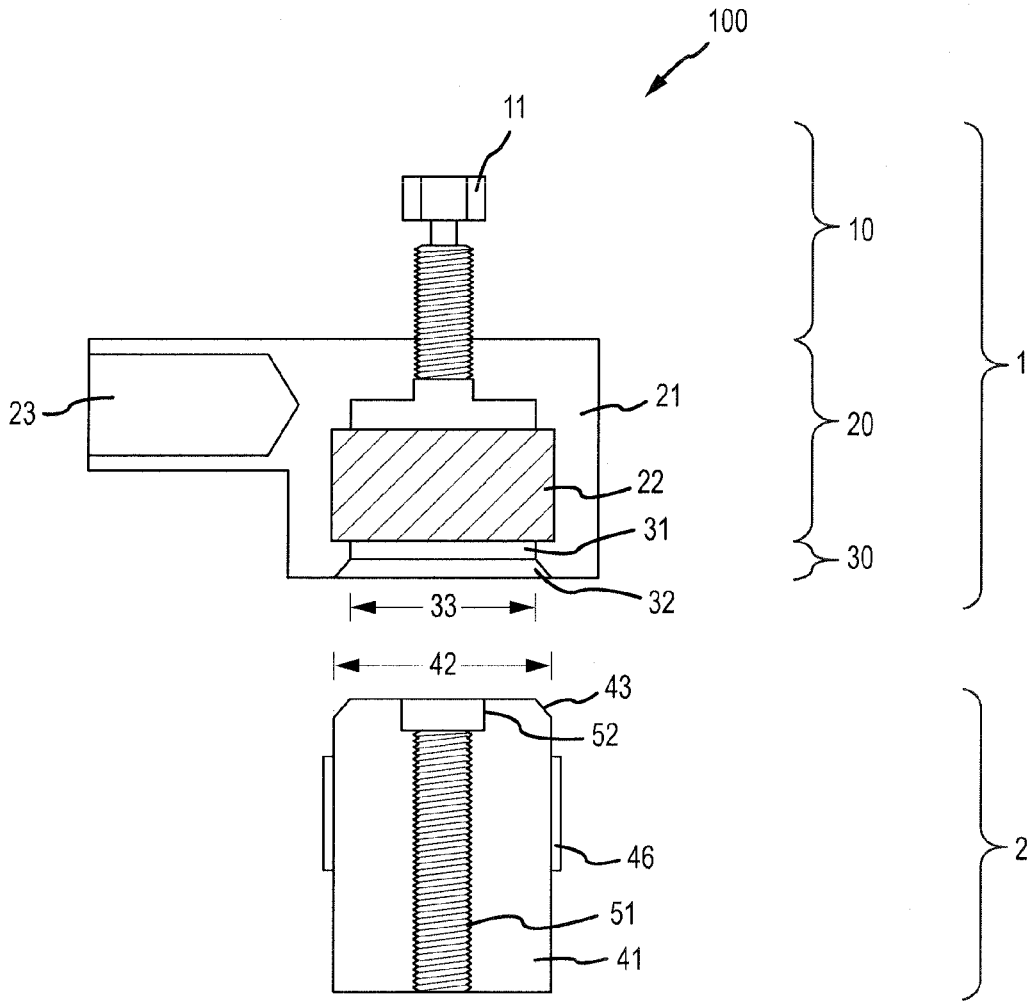
FIG. 2 illustrates a side view of a keyed power connection system, according to various embodiments.
Figure 3:
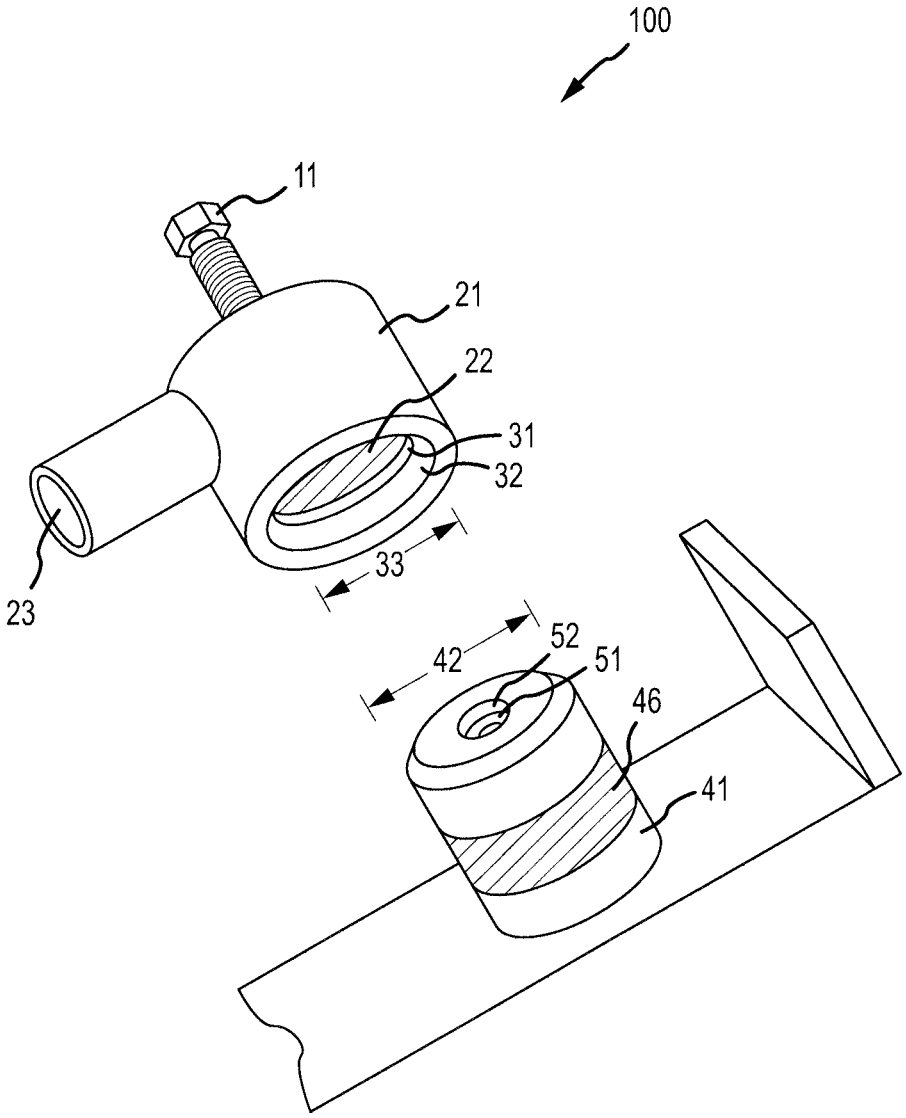
FIG. 3 illustrates an isometric view of a keyed power connection system, according to various embodiments.

With reference now to FIGS. 1, 2 and 3, various aspects of the connector 1 and the terminal stud 2 are discussed in further detail.

A connector fastening portion 10 of a connector 1 may comprise a captive fastener 11. A captive fastener 11 may comprise a threaded bolt extending through a portion of the connector 1, for instance, through an opening in the top of the connector 1 and extending into the connector electrical conduction portion 20. The captive fastener 11 may be threaded to correspond to the terminal stud fastening portion 50 of a terminal stud 2. Thus, the captive fastener 11 may be connected/disconnected from the terminal stud fastening portion 50 of the terminal stud 2, thereby holding the connector electrical conduction portion 20 of the connector 1 in physical connection with the terminal stud electrical conduction portion 45 of the terminal stud 2.

A connector electrical conduction portion 20 of a connector 1 may comprise a connector body 21. A connector body 21 may comprise a housing configured to retain the connector fastening portion 10 (e.g., the captive fastener 11) in movable communication with the connector 1. For example, the captive fastener 11 may extend through a hole in the connector body 21 so that the captive fastener 11 extends through the connector body 21 and is positioned to interface with the terminal stud 2. The connector body 21 may be further configured to support the connector conductive surface 22 in a desired position, such as to provide rigidity to the connector conductive surface 22 when positioned in physical contact with the terminal stud conductive surface 46 of the terminal stud electrical conduction portion 45. In various embodiments, the connector body 21 may comprise metal, although in further embodiments, it may comprise ceramic, or plastic, or may comprise coatings, such as a metal coated with a ceramic or plastic and/or the like. For instance, the connector body 21 may be conductive and may be pressed into mechanical contact with a corresponding plane of a post 41 such as may surround the base of the post 41 from which the post 41 orthogonally extends.

A connector electrical conduction portion 20 may comprise a connector conductive surface 22. The connector conductive surface 22 may comprise an integral portion of the connector body 21, for example, such as for connector body 21 made of a conductive material. The connector conductive surface 22 may comprise an annular portion of a cylindrical void defined by the connector body 21 and arranged to receive at least a portion of a terminal stud 2. In various embodiments, the connector electrical conduction portion 20 may comprise a connector conductive surface 22 comprising an insert. For instance, the connector conductive surface 22 may comprise an annular insert disposed within an aperture defined by the connector body 21 and arranged to receive at least a portion of a terminal stud 2.

A connector keying portion 30 of a connector 1 may comprise a connector keyed aperture 31. The connector keyed aperture 31 may comprise an opening in and defined by the connector body 21. The connector keyed aperture 31 may provide a passage for a portion of the terminal stud 2 to pass into the connector 1 so that the connector electrical conduction portion 20 and the terminal stud electrical conduction portion 45 may make physical contact with one another. The connector keyed aperture 31 may comprise a shape corresponding to the shape of the terminal stud 2. For instance, the connector keyed aperture 31 may comprise a circular opening onto a cylindrical void defined by the connector body 21. In various embodiments, the connector keyed aperture 31 may comprise any shape as desired.

A connector keying portion 30 may comprise a keyed connector diameter 33. A keyed connector diameter 33 may comprise a diameter of the connector keyed aperture 31. The keyed connector diameter 33 may be sized to correspond to a measurement of the terminal stud 2. For example, the keyed connector diameter 33 may comprise a dimension corresponding to a keyed stud diameter 42 of a terminal stud keying portion 40 of a terminal stud 2. In various embodiments, the keyed connector diameter 33 comprises the same dimension as the keyed stud diameter 42 plus a tolerance. For example, by changing the keyed connector diameter 33 and the keyed stud diameter 42 by a selected increment (for instance 1 mm), the connector 1 may be configured to properly connect only to those terminal studs 2 having a corresponding keyed stud diameter 42. In various embodiments, for example, those wherein the keyed stud diameter 42 is variable in 1 mm increments, the keyed connector diameter 33 corresponds to the same dimension plus a tolerance of, for instance, 0.1 mm or 0.01 mm. or 0.5 mm or 0.05 mm, or any tolerance as desired, allowing for the connector 1 to slip over and receive a portion of the terminal stud 2.

A connector keying portion 30 may comprise a connector alignment chamfer 32. A connector alignment chamfer 32 may comprise an annular chamfer immediately outward of the connector keyed aperture 31 and defined by the connector body 21. The connector alignment chamfer 32 may facilitate seating of the connector 1 on to a terminal stud 2 and may facilitate guidance of a portion of the terminal stud 2 into the connector 1. For instance, the connector alignment chamfer 32 may correspond to the same dimension as the keyed stud diameter 42, plus a tolerance of, for instance, 0.1 mm or 0.01 mm. or 0.5 mm or 0.05 mm, plus an additional tolerance of, for instance, 0.1 mm or 0.01 mm. or 0.5 mm or 0.05 mm, or any tolerance as desired to facilitate manual alignment and guidance to the connector 1 and the terminal stud 2 together.

Having discussed aspects of the connector 1 in detail, focus is directed to the terminal stud 2. Particularly, focus is given to the terminal stud keying portion 40, the terminal stud electrical conduction portion 45, and the terminal stud fastening portion 50.

A terminal stud keying portion 40 of a terminal stud 2 may comprise a post 41 configured to support a terminal stud fastening portion 50 (e.g., the fastener receiving threaded bore 51 and/or fastener receiving counter bore 52) whereby a connector fastening portion 10 (e.g., captive fastener 11) of a connector 1 is received. A post 41 may comprise a fixture, such as a cylindrical boss, arranged to support the terminal stud electrical conduction portion 45 in a desired position, such as to provide rigidity to the terminal stud conductive surface 46 when positioned in physical contact with the connector conductive surface 22. In various embodiments, the post 41 comprises metal, although in further embodiments, it may comprise ceramic, or plastic, or may comprise coatings, such as a metal coated with a ceramic or plastic and/or the like.

A terminal stud keying portion 40 may comprise a keyed stud diameter 42. A keyed stud diameter 42 may comprise a diameter of the terminal stud 2. The keyed stud diameter 42 may be sized to correspond to a measurement of the connector 1. For example, the keyed stud diameter 42 may comprise a dimension corresponding to a keyed connector diameter 33 of a connector keying portion 30 of a connector 1. In various embodiments, the keyed stud diameter 42 comprises the same dimension as the keyed connector diameter 33 minus a tolerance. For example, by changing the keyed connector diameter 33 and the keyed stud diameter 42 by a selected increment (for instance 1 mm), the terminal stud 2 may be configured to properly connect only to those connectors 1 having a corresponding diameter, allowing for the connector 1 to slip over and receive a portion of the terminal stud 2.

A terminal stud keying portion 40 may comprise a terminal stud alignment chamfer 43. A terminal stud alignment chamfer 43 may comprise an annular chamfer disposed at the tip of the post 41. The terminal stud alignment chamfer 43 may facilitate seating of the connector 1 on to a terminal stud 2 and may facilitate guidance of the connector 1 over the terminal stud 2. For instance, the terminal stud alignment chamfer 43 may correspond to the same dimension as the keyed stud diameter 42 at one end of the annular chamfer, then comprise a reduced diameter at an outermost end of the post 41 (e.g., an axially outermost tip) to facilitate manual alignment and guidance to the connector 1 and the terminal stud 2 together.

A terminal stud electrical conduction portion 45 of a terminal stud 2 may comprise a terminal stud conductive surface 46. The terminal stud conductive surface 46 may comprise an integral portion of the post 41, for example, such as for a post 41 made of a conductive material, terminal stud conductive surface 46 may comprise an annular surface of the post 41 and arranged to rest inside the connector body 21 in contact with the connector conductive surface 22. In various embodiments, the terminal stud electrical conduction portion 45 comprises an insert. For instance, the terminal stud conductive surface 46 may comprise an annular insert disposed over the outer circumferential surface of the post 41 and arranged to rest inside the connector body 21 in contact with the connector conductive surface 22.

A terminal stud fastening portion 50 of a terminal stud 2 may comprise a fastener receiving threaded bore 51. The fastener receiving threaded bore 51 may comprise a cylindrical channel defined by the post 41 and extending axially into the post 41. The fastener receiving threaded bore 51 may be positioned and sized to correspond to the captive fastener 11 of the connector fastening portion 10. The fastener receiving threaded bore 51 may be threaded to correspond to the threads of the captive fastener 11. Thus, the fastener receiving threaded bore 51 may receive the captive fastener 11 and may be loaded in tension as the captive fastener 11 is tightened into fastener receiving threaded bore 51, retaining the connector 1 in position relative to the stud 2. In various embodiments, the fastener receiving threaded bore 51 is integrally formed with the stud 2. In various embodiments, the fastener receiving threaded bore 51 comprises an insert disposed within the stud 2. Thus, the fastener receiving threaded bore 51 may further comprise a different material than the post 41, although in various embodiments, it is an integral feature of the post 41.

A terminal stud fastening portion 50 may comprise a fastener receiving counter bore 52. The fastener receiving counter bore 52 may comprise a bore defined by the post 41 and disposed closer to the tip than (axially outward of) the fastener receiving threaded bore 51 and co-axially aligned with the fastener receiving threaded bore 51. The fastener receiving counter bore 52 may have a diameter greater than that of the fastener receiving threaded bore 51. In this manner, the fastener receiving counter bore 52 may facilitate seating of the captive fastener 11 within the fastener receiving threaded bore 51 and facilitate initial threading of the captive fastener 11 into the fastener receiving threaded bore 51. For instance, the fastener receiving counter bore 52 may facilitate guidance of a portion of the captive fastener 11 into the fastener receiving threaded bore 51.

Various benefits and advantages have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, and any elements that may cause any benefit or advantage to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

Systems, methods and apparatus are provided herein. In the detailed description herein, references to "various embodiments", "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A keyed power connection system comprising:

a connector comprising:

a connector fastening portion comprising a captive fastener;

a connector electrical conduction portion comprising a connector body configured to retain the connector fastening portion extending through the connector body and in movable communication with the connector body, and comprising a connector conductive surface having an annular insert disposed within an aperture defined by the connector body; and a connector keying portion comprising a keyed aperture forming an opening in and defined by the connector body such that the connector conductive surface is disposed within the keyed aperture, and comprising a keyed connector diameter, wherein the captive fastener extends through at least a portion of the connector body and is configured to be received by a terminal stud.

2. The keyed power connection system according to claim 1, wherein the connector conductive surface comprises an integral portion of the connector body.

3. The keyed power connection system according to claim 1, wherein the captive fastener comprises a threaded bolt extending through the connector electrical conduction portion.

4. The keyed power connection system of claim 1, wherein the connector keying portion further comprises a connector alignment chamfer comprising an annular chamfer disposed outward of the keyed aperture and defined by the connector body and configured to facilitated seating of the connector onto a terminal stud.

5. The keyed power connection system of claim 1, further comprising:

the terminal stud comprising:

a terminal stud keying portion comprising:

a post comprising a cylindrical boss configured to support a terminal stud fastening portion whereby the connector fastening portion is received, a keyed stud diameter comprising a diameter of the post substantially equal to the keyed connector diameter, and a terminal stud electrical conduction portion comprising a terminal stud conductive surface disposed annularly about the post; and the terminal stud fastening portion comprising a fastener receiving threaded bore comprising a cylindrical channel defined by the post and extending axially into the post and positioned and sized to correspond to the captive fastener of the connector fastening portion of the connector.

6. The keyed power connection system of claim 5, wherein the terminal stud fastening portion is integrally formed with the post.

7. The keyed power connection system of claim 5, wherein the terminal stud fastening portion comprises an insert disposed in the post.

8. The keyed power connection system of claim 5, wherein the terminal stud keying portion further comprises a terminal stud alignment chamfer comprising an annular chamfer disposed at a tip of the post.

9. The keyed power connection system of claim 8, wherein the connector keying portion further comprises a connector alignment chamfer comprising an annular chamfer disposed outward of the keyed aperture and defined by the connector body, wherein the terminal stud alignment chamfer has a shape corresponding the connector alignment chamfer.

10. The keyed power connection system of claim 5, wherein the terminal stud fastening portion further comprises a fastener receiving counter bore comprising a bore defined by the post of the terminal stud and located coaxially with the fastener receiving threaded bore and having a diameter greater than that of the fastener receiving threaded bore.

11. A keyed power connection system comprising:

a terminal stud comprising:

a terminal stud keying portion comprising:

a post comprising a cylindrical boss configured to support a terminal stud fastening portion having a fastener receiving threaded bore comprising a cylindrical channel defined by the post and extending axially into the post, a keyed stud diameter comprising a diameter of the post, and a terminal stud electrical conduction portion comprising a terminal stud conductive surface disposed annularly about the post; and a connector comprising:

a connector electrical conduction portion having a connector body and a connector conductive surface having an annular insert disposed within an aperture defined by the connector body, a connector keying portion having a keyed aperture such that the connector conductive surface is disposed within the keyed aperture, and a captive fastener extending through at least a portion of the connector body and configured to be received by the terminal stud fastening portion.

12. The keyed power connection system according to claim 11, wherein the keyed stud diameter is configured to substantially equal a keyed connector diameter of the connector, wherein the post is configured to be received within the connector.

13. The keyed power connection system according to claim 11, wherein the connector further includes a connector fastening portion comprising the captive fastener, wherein the connector body is configured to retain the connector fastening portion in movable communication with the connector, the keyed aperture forms an opening in and defined by the connector body and comprising a keyed connector diameter, the connector is configured to receive the terminal stud having the keyed stud diameter into the connector, and the keyed connector diameter comprises a diameter of the keyed aperture configured to substantially equal the keyed stud diameter.

* * * * *